US008085284B2

(12) United States Patent
Tokimoto et al.

(10) Patent No.: US 8,085,284 B2
(45) **Date of Patent: *Dec. 27, 2011**

(54) METHOD AND APPARATUS FOR DISPLAYING BITMAP MULTI-COLOR IMAGE DATA ON DOT MATRIX-TYPE DISPLAY SCREEN ON WHICH THREE PRIMARY COLOR LAMPS ARE DISPERSEDLY ARRAYED

(75) Inventors: Toyotaro Tokimoto, Yokohama (JP); Masatoshi Ohishi, Zushi (JP)

(73) Assignee: AVIX Inc., Yokohama-shi, Kanagawa (JP)

( * ) Notice: Subject to any disclaimer, the term of this patent is extended or adjusted under 35 U.S.C. 154(b) by 631 days.

This patent is subject to a terminal disclaimer.

(21) Appl. No.: 11/516,330

(22) Filed: Sep. 6, 2006

(65) Prior Publication Data

US 2007/0046689 A1 Mar. 1, 2007

Related U.S. Application Data

(63) Continuation of application No. 09/701,095, filed as application No. PCT/JP00/01833 on Mar. 24, 2000, now Pat. No. 7,187,393.

(30) Foreign Application Priority Data

Mar. 24, 1999 (JP) ..... 11-79664

(51) Int. Cl.
*G09G 5/02* (2006.01)

(52) U.S. Cl. ..... 345/698; 345/694

(58) Field of Classification Search ..... 345/83, 345/613, 690, 691, 694, 695, 698
See application file for complete search history.

(56) References Cited

U.S. PATENT DOCUMENTS 5,278,542 A 1/1994 Smith et al. ..... 345/690
5,717,417 A 2/1998 Takahashi
5,808,464 A 9/1998 Natori et al.
5,808,592 A 9/1998 Mizutani et al.

(Continued)

FOREIGN PATENT DOCUMENTS

DE 197 46 329 3/1999

(Continued)

OTHER PUBLICATIONS

Israeli Office Action issued Nov. 2, 2008 with English translation.

(Continued)

*Primary Examiner* — Jeffery A Brier
(74) *Attorney, Agent, or Firm* — Collard & Roe, P.C.

(57) ABSTRACT

A display screen comprises many pixel lamps arrayed uniformly and in a regular pattern. Pixel lamps come in three types (first- to third-color lamps), and image data to be displayed on the screen consist of bit-map type multi-colored data in which one pixel is represented by a set of three-type color data (first- to third-color data). Each color data plane on a bit-map image data plane is divided into many groups each consisting of a plurality of contiguous pixels, each group is correlated to each first color lamp on the display screen, an operation of selecting in a preset sequence first-color data of a plurality of pixels belonging to one group is repeated, and a first-color lamp correlating to each group is emission-driven according to a selected first-color data. (The same steps are followed for second- and third-color lamps).

1 Claim, 5 Drawing Sheets

| | | | | | | | |
|---|---|---|---|---|---|---|---|
| $R_{11}$ | $G_{12}$ | $R_{13}$ | $G_{14}$ | $R_{15}$ | $G_{16}$ | $R_{17}$ | $G_{18}$ |
| $G_{21}$ | $B_{22}$ | $G_{23}$ | $B_{24}$ | $G_{25}$ | $B_{26}$ | $G_{27}$ | $B_{28}$ |
| $R_{31}$ | $G_{32}$ | $R_{33}$ | $G_{34}$ | $R_{35}$ | $G_{36}$ | $R_{37}$ | $G_{38}$ |
| $G_{41}$ | $B_{42}$ | $G_{43}$ | $B_{44}$ | $G_{45}$ | $B_{46}$ | $G_{47}$ | $B_{48}$ |
| $R_{51}$ | $G_{52}$ | $R_{53}$ | $G_{54}$ | $R_{55}$ | $G_{56}$ | $R_{57}$ | $G_{58}$ |
| $G_{61}$ | $B_{62}$ | $G_{63}$ | $B_{64}$ | $G_{65}$ | $B_{66}$ | $G_{67}$ | $B_{68}$ |
| $R_{71}$ | $G_{72}$ | $R_{73}$ | $G_{74}$ | $R_{75}$ | $G_{76}$ | $R_{77}$ | $G_{78}$ |
| $G_{81}$ | $B_{82}$ | $G_{83}$ | $B_{84}$ | $G_{85}$ | $B_{86}$ | $G_{87}$ | $B_{88}$ |

U.S. PATENT DOCUMENTS

| | | | | |
|---|---|---|---|---|
| 5,995,070 | A | 11/1999 | Kitada | |
| 6,078,307 | A | 6/2000 | Daly | 345/698 |
| 6,198,467 | B1 | 3/2001 | Chiang | 345/698 |
| 6,661,429 | B1 | 12/2003 | Phan | 345/684 |
| 2004/0061710 | A1 | 4/2004 | Messing et al. | 345/698 |

FOREIGN PATENT DOCUMENTS

| | | |
|---|---|---|
| EP | 869468 | 10/1998 |
| JP | 8-153895 | 6/1996 |
| JP | 8-202292 | 8/1996 |
| JP | 09 319332 | 12/1997 |
| JP | 10-293558 | 11/1998 |
| JP | 11-316568 | 11/1999 |

OTHER PUBLICATIONS

First Examination Report dated Sep. 17, 2008 in corresponding European Patent Application No. 00 911 359.8.

Second Chinese Office Action issued Mar. 26, 2004 in the counterpart Chinese Patent Application No. 00800629.6.

Office Action issued Mar. 14, 2005 in the counterpart European Patent Application No. 00911359.8.

Mar. 19, 2006 Office Action in Israeli Patent Application No. 139,818 (with translation of relevant part).

Office Action issued Jan. 19, 2005 in the counterpart Israeli Patent Application No. 139,818 along with English translation.

FIG. 1

| | | | | | | | |
|---|---|---|---|---|---|---|---|
| $R_{11}$ | $G_{12}$ | $R_{13}$ | $G_{14}$ | $R_{15}$ | $G_{16}$ | $R_{17}$ | $G_{18}$ |
| $G_{21}$ | $B_{22}$ | $G_{23}$ | $B_{24}$ | $G_{25}$ | $B_{26}$ | $G_{27}$ | $B_{28}$ |
| $R_{31}$ | $G_{32}$ | $R_{33}$ | $G_{34}$ | $R_{35}$ | $G_{36}$ | $R_{37}$ | $G_{38}$ |
| $G_{41}$ | $B_{42}$ | $G_{43}$ | $B_{44}$ | $G_{45}$ | $B_{46}$ | $G_{47}$ | $B_{48}$ |
| $R_{51}$ | $G_{52}$ | $R_{53}$ | $G_{54}$ | $R_{55}$ | $G_{56}$ | $R_{57}$ | $G_{58}$ |
| $G_{61}$ | $B_{62}$ | $G_{63}$ | $E_{64}$ | $G_{65}$ | $B_{66}$ | $G_{67}$ | $B_{68}$ |
| $R_{71}$ | $G_{72}$ | $R_{73}$ | $G_{74}$ | $R_{75}$ | $G_{76}$ | $R_{77}$ | $G_{78}$ |
| $G_{81}$ | $B_{82}$ | $G_{83}$ | $B_{84}$ | $G_{85}$ | $B_{86}$ | $G_{87}$ | $B_{88}$ |

FIG. 2

| | | | | | | | |
|---|---|---|---|---|---|---|---|
| r 1 1<br>g 1 1<br>b 1 1 | r 1 2<br>g 1 2<br>b 1 2 | r 1 3<br>g 1 3<br>b 1 3 | r 1 4<br>g 1 4<br>b 1 4 | r 1 5<br>g 1 5<br>b 1 5 | r 1 6<br>g 1 6<br>b 1 6 | r 1 7<br>g 1 7<br>b 1 7 | r 1 8<br>g 1 8<br>b 1 8 |
| r 2 1<br>g 2 1<br>b 2 1 | r 2 2<br>g 2 2<br>b 2 2 | r 2 3<br>g 2 3<br>b 2 3 | r 2 4<br>g 2 4<br>b 2 4 | r 2 5<br>g 2 5<br>b 2 5 | r 2 6<br>g 2 6<br>b 2 6 | r 2 7<br>g 2 7<br>b 2 7 | r 2 8<br>g 2 8<br>b 2 8 |
| r 3 1<br>g 3 1<br>b 3 1 | r 3 2<br>g 3 2<br>b 3 2 | r 3 3<br>g 3 3<br>b 3 3 | r 3 4<br>g 3 4<br>b 3 4 | r 3 5<br>g 3 5<br>b 3 5 | r 3 6<br>g 3 6<br>b 3 6 | r 3 7<br>g 3 7<br>b 3 7 | r 3 8<br>g 3 8<br>b 3 8 |
| r 4 1<br>g 4 1<br>b 4 1 | r 4 2<br>g 4 2<br>b 4 2 | r 4 3<br>g 4 3<br>b 4 3 | r 4 4<br>g 4 4<br>b 4 4 | r 4 5<br>g 4 5<br>b 4 5 | r 4 6<br>g 4 6<br>b 4 6 | r 4 7<br>g 4 7<br>b 4 7 | r 4 8<br>g 4 8<br>b 4 8 |
| r 5 1<br>g 5 1<br>b 5 1 | r 5 2<br>g 5 2<br>b 5 2 | r 5 3<br>g 5 3<br>b 5 3 | r 5 4<br>g 5 4<br>b 5 4 | r 5 5<br>g 5 5<br>b 5 5 | r 5 6<br>g 5 6<br>b 5 6 | r 5 7<br>g 5 7<br>b 5 7 | r 5 8<br>g 5 8<br>b 5 8 |
| r 6 1<br>g 6 1<br>b 6 1 | r 6 2<br>g 6 2<br>b 6 2 | r 6 3<br>g 6 3<br>b 6 3 | r 6 4<br>g 6 4<br>b 6 4 | r 6 5<br>g 6 5<br>b 6 5 | r 6 6<br>g 6 6<br>b 6 6 | r 6 7<br>g 6 7<br>b 6 7 | r 6 8<br>g 6 8<br>b 6 8 |
| r 7 1<br>g 7 1<br>b 7 1 | r 7 2<br>g 7 2<br>b 7 2 | r 7 3<br>g 7 3<br>b 7 3 | r 7 4<br>g 7 4<br>b 7 4 | r 7 5<br>g 7 5<br>b 7 5 | r 7 6<br>g 7 6<br>b 7 6 | r 7 7<br>g 7 7<br>b 7 7 | r 7 8<br>g 7 8<br>b 7 8 |
| r 8 1<br>g 8 1<br>b 8 1 | r 8 2<br>g 8 2<br>b 8 2 | r 8 3<br>g 8 3<br>b 8 3 | r 8 4<br>g 8 4<br>b 8 4 | r 8 5<br>g 8 5<br>b 8 5 | r 8 6<br>g 8 6<br>b 8 6 | r 8 7<br>g 8 7<br>b 8 7 | r 8 8<br>g 8 8<br>b 8 8 |

FIG. 3

| | | | | | | | | |
|---|---|---|---|---|---|---|---|---|
| $R_{11}$ | $G_{12}$ | $B_{13}$ | $R_{14}$ | $G_{15}$ | $B_{16}$ | $R_{17}$ | $G_{18}$ | $B_{19}$ |
| $G_{21}$ | $B_{22}$ | $R_{23}$ | $G_{24}$ | $B_{25}$ | $R_{26}$ | $G_{27}$ | $B_{28}$ | $R_{29}$ |
| $B_{31}$ | $R_{32}$ | $G_{33}$ | $B_{34}$ | $R_{35}$ | $G_{36}$ | $B_{37}$ | $R_{38}$ | $G_{39}$ |
| $R_{41}$ | $G_{42}$ | $B_{43}$ | $R_{44}$ | $G_{45}$ | $B_{46}$ | $R_{47}$ | $G_{48}$ | $B_{49}$ |
| $G_{51}$ | $B_{52}$ | $R_{53}$ | $G_{54}$ | $B_{55}$ | $R_{56}$ | $G_{57}$ | $B_{58}$ | $R_{59}$ |
| $B_{61}$ | $R_{62}$ | $G_{63}$ | $B_{64}$ | $R_{65}$ | $G_{66}$ | $B_{67}$ | $R_{68}$ | $G_{69}$ |
| $R_{71}$ | $G_{72}$ | $B_{73}$ | $R_{74}$ | $G_{75}$ | $B_{76}$ | $R_{77}$ | $G_{78}$ | $B_{79}$ |
| $G_{81}$ | $B_{82}$ | $R_{83}$ | $G_{84}$ | $B_{85}$ | $R_{86}$ | $G_{87}$ | $B_{88}$ | $R_{89}$ |
| $B_{91}$ | $R_{92}$ | $G_{93}$ | $B_{94}$ | $R_{95}$ | $G_{96}$ | $B_{97}$ | $R_{98}$ | $G_{99}$ |

METHOD AND APPARATUS FOR DISPLAYING BITMAP MULTI-COLOR IMAGE DATA ON DOT MATRIX-TYPE DISPLAY SCREEN ON WHICH THREE PRIMARY COLOR LAMPS ARE DISPERSEDLY ARRAYED

CROSS REFERENCE TO RELATED APPLICATIONS

This application is a continuation and claims priority under 35 U.S.C. §120 of U.S. patent application Ser. No. 09/701,095 filed Nov. 22, 2000 now U.S. Pat. No. 7,187,393, which claims the benefit as a National Stage entry of a PCT application pursuant to 35 U.S.C. §371 of International Application No. PCT/JP00/01833 filed Mar. 24, 2000, published in the Japanese language, which in turn claims priority under 35 U.S.C. §119 of Japanese Application No. 11-79664, filed Mar. 24, 1999. Applicant also claims priority under 35 U.S.C. §365 of PCT/JP00/01833, filed Mar. 24, 2000. The international application under PCT article 21(2) was not published in English.

BACKGROUND OF THE INVENTION

1. Field of the Invention

This invention relates to a method and an apparatus for displaying bitmap multi-color image data on a dot matrix-type display screen on which three primary color lamps consisting of light emitting diodes (LED) or the like are dispersedly arrayed, and more particularly, to a technology for realizing a full color display of high fineness and high quality.

2. The Prior Art

As one of typical examples, description will be made for a dot matrix-type LED full color display apparatus of 480 vertical lines and 128 horizontal dots. Each of the pixel lamps which are in total 61,440 pieces is an LED multi-color gathered lamp in which LEDs of three primary colors of RGB (red, green and blue) are densely arranged. Pixel data for activating one pixel lamp consists of 8 bits for each RGB, that is, 24 bit data in total, and is capable of full color expression of 16,777,216 colors. The image data for one screen is data of (61,440×24) bits.

In the case of a small display screen, the LED multi-color lamp is used, where each LED chip in RGB is molded in one lens body, and each of the LED multi-color lamps is evenly arranged, as one pixel lamp, in a matrix state on a screen. In the case of a large display screen, red LED lamps, green LED lamps and blue LED lamps that are molded respectively in a lens body are gathered in an appropriate number to constitute one LED multi-color gathered lamp, and the gathered lamps are evenly arranged one by one, as one pixel lamp, in a matrix state on a screen.

In both cases, in order to visualize an image on the screen, one piece of pixel data in the bitmap image data is allotted to one pixel lamp in a display screen, and the red lamp, the green lamp and the blue lamp in one pixel lamp are respectively activated to emit light according to red data, green data and blue data included in one piece of pixel data.

Recently, as blue LEDs having high luminance has been put into practical use, research and development concerning LED full-color displaying apparatuses of the dot matrix-type have started in full-scale. Former LED display apparatuses have dealt entirely with very simple images such as advertisement messages or guide messages constituted of characters and designs. Having passed such an era, recently, a variety of images, such as actually-filmed images or computer graphics images that are provided on an NTSC video signal used in a regular television broadcasting system or a VTR, or on a Hi-vision video signal, have become increasingly used. Image technology of a television broadcasting system has evolved significantly through a long history of research and development, and image expression performance of the NTSC video signal or the Hi-vision video signal have gone far beyond the expression capability of the current LED full color display apparatus. Therefore, demand for higher performance in the LED full color display apparatus has significantly increased.

Two approaches are conceived for making the LED full color display apparatus possess a higher performance. One is to increase an array density of the pixel lamps that constitute a display screen in order to improve resolution. The other is to devise an aspect of the image signal process such that the NTSC video signal or the Hi-vision video signal can be adapted to the LED full color display apparatus whose physical expression capability is difficult to be improved, without spoiling to the furthest extent, the high image-expression ability of these signals.

SUMMARY OF THE INVENTION

This invention was made based on the technical views that have been described in the previous paragraphs, and an object is to realize a full color display of high fineness and high quality on a dot matrix-type display screen where three primary color lamps are dispersedly arrayed.

=First Invention=

The first invention is specified by the following items (1)-(7).

(1) The present invention is a method for displaying bitmap multi-color image data on a dot matrix-type display screen on which three primary color lamps are dispersedly arrayed.

(2) A large number of pixel lamps are evenly arrayed in a regular pattern to constitute a display screen, the pixel lamps being three kinds of color lamps which are a first color lamp, a second color lamp and a third color lamp, and these three kinds of pixel lamps being evenly dispersed on the display screen.

(3) Image data to be displayed on the screen is multi-color data of a bitmap format, in which one pixel is expressed by a gathering of first color data, second color data and third color data.

(4) A first color data plane on a bitmap image data plane is divided into a multitude of groups wherein each group is composed of a plurality of pixels arranged adjacently to each other; each group is made to correspond to each first color lamp on the display screen, an action of selecting, in a specified order, the first color data of a plurality of pixels that belong to one group is repeated at high speed; and the first color lamp corresponding to each group is activated to emit light according to the selected first color data.

(5) A second color data plane on a bitmap image data plane is divided into a multitude of groups wherein each group is composed of a plurality of pixels arranged adjacently to each other; each group is made to correspond to each second color lamp on the display screen; an action of selecting, in a specified order, the second color data of a plurality of pixels that belong to one group is repeated at high speed; and the second color lamp corresponding to each group is activated to emit light according to the selected second color data.

(6) A third color data plane on a bitmap image data plane is divided into a multitude of groups wherein each group is composed of a plurality of pixels arranged adjacently to each other: each group is made to correspond to each third color lamp on the display screen; an action of selecting, in a specified order, the third color data of a plurality of pixels that belong to one group is repeated at high speed; and the third color lamp corresponding to each group is activated to emit light according to the selected third color data.

(7) The way the first color data plane is grouped, the second color data plane is grouped, and the third color data plane is grouped is such that the groups are mutually positionally-shifted on the bitmap image data plane while being partially overlapped, interrelating with a positional-shift in the arrays of the first color lamp, the second color lamp, and the third color lamp on the display screen.

=Second Invention=

The method of the first invention is characterized in that a total of four pixels, adjacent each other in two rows and two columns on said bitmap image data plane, constitute one of the groups.

=Third Invention=

The method of the first invention is characterized in that a total of nine pixels, adjacent each other in three rows and three columns on said bitmap image data plane, constitute one of the groups.

=Fourth Invention=

The method of the first invention is characterized in that a total of sixteen pixels, adjacent each other in four rows and four columns on said bitmap image data plane, constitute one of the groups.

=Fifth Invention=

The method of the first invention is characterized in that said groups having the same color are partially overlapped on said bitmap image data plane.

=Sixth Invention=

The method of the first invention is characterized in that said groups having the same color do not partially overlap on said bitmap image data plane.

=Seventh Invention=

The method of the first invention is characterized in that regularity for orderly selecting a plurality of pixels that belong to one group is unified into one.

=Eighth Invention=

The method of the first invention is characterized in that regularity for orderly selecting a plurality of pixels that belong to one group is different among adjacent groups.

=Ninth Invention=

A display apparatus according to the ninth invention is an apparatus that operates based on the display method according to any one of the first to eighth inventions, comprising: a dot matrix-type display screen section in which said first color lamps, said second color lamps and said third color lamps are dispersedly arrayed; an activating circuit section for individually activating said first lamps, second lamps and third lamps to emit light; an image data storing section for storing bitmap multi-color image data to be displayed; and a data distribution control section for distributing and transferring the image data stored in the image data storing section to said activating circuit section.

BRIEF DESCRIPTION OF THE DRAWINGS

FIG. 1 is an explanatory view of a pixel lamp array of a display screen according to one embodiment of the present invention.

FIG. 2 is a schematic view of bitmap image data, explaining the operation of the present invention.

FIG. 3 is an explanatory view of a pixel lamp array of a display screen according to another embodiment of the present invention.

DETAILED DESCRIPTION OF PREFERRED EMBODIMENTS

Figure 4:
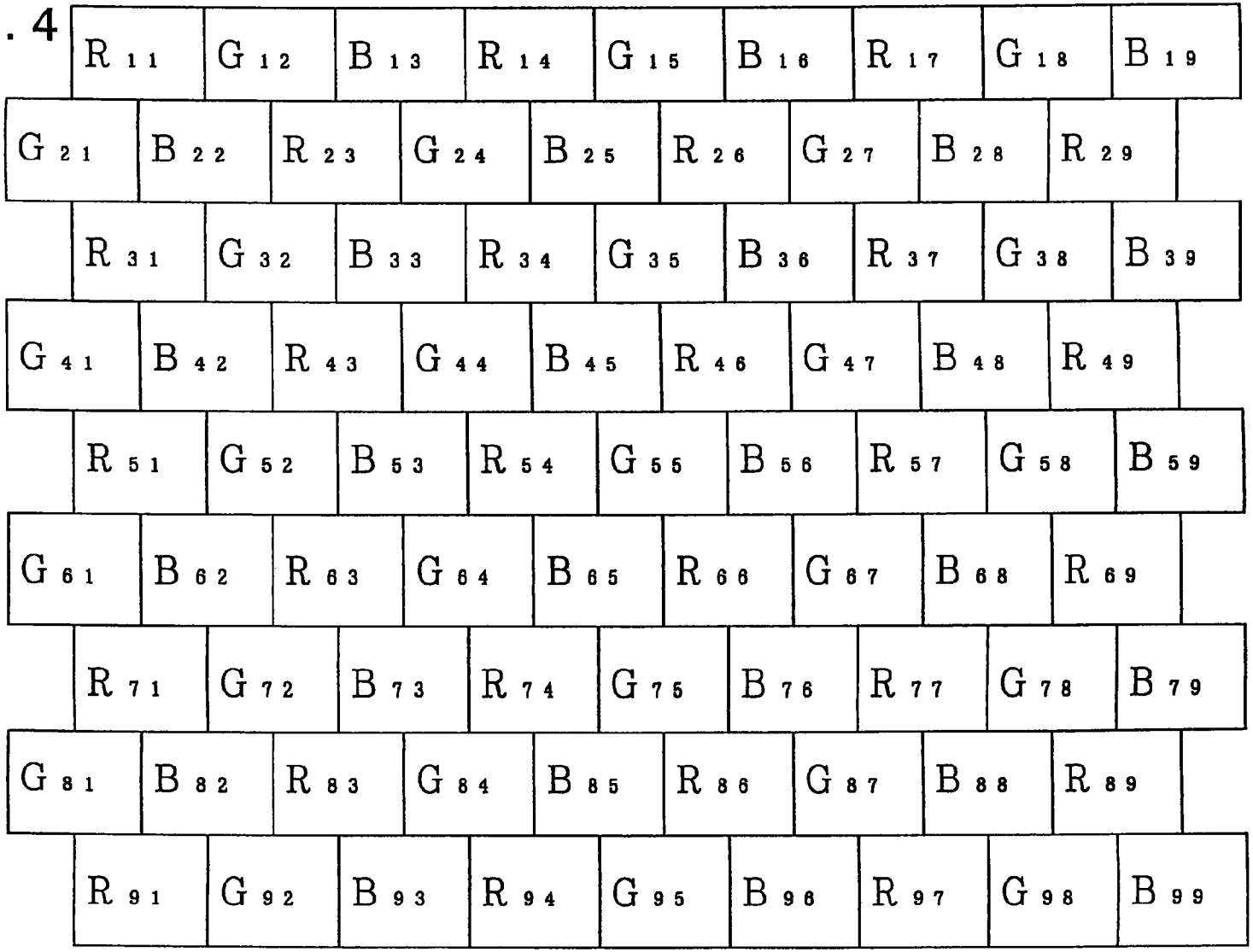
FIG. 4 is an explanatory view of the pixel lamp array of the display screen according to another embodiment of the present invention.

=Example of Pixel Lamp Array of Display Screen=

FIG. 1 shows a pixel lamp array according to one embodiment of the present invention. It is needless to say that the array shown is not the entire display screen but a part thereof. On the display screen, a large number of pixel lamps are regularly arranged in a matrix state at a fixed pitch in the vertical and horizontal direction. The pixel lamps are three kinds of color lamps which are: red lamps R, green lamps G and blue lamps B. These lamps are LED lamps. As described in the background art, one pixel lamp is not constituted by densely gathering the red lamp, the green lamp and the blue lamp. The red lamps R, the green lamps G and the blue lamps B are arranged one by one in a matrix state at a fixed pitch regardless of its color, and the red lamps R, the green lamps G and the blue lamps B are evenly dispersed on the display screen, respectively.

Note that the "one piece" of the red lamp R, the green lamp G or the blue lamp B in this description not only literally denotes the lamp that is constituted of one piece of LED chip, but also is an expression that includes a lamp having a plurality of LED chips of the same color arranged densely.

In the specific example shown in FIG. 1, the red lamps R and the green lamps G are alternately arrayed on an odd-numbered row, and the green lamps G and the blue lamps B are alternately arrayed on an even-numbered row. Note that the green lamp G is arranged under the red lamp R, and the alternate array of the red lamps R and the green lamps G and the alternate array of the green lamps G and the blue lamps B are adjacent to each other in the array direction.

The total number of the respective red lamps R, the green lamps G and the blue lamps B on the entire screen has a ratio of (1:2:1). And, when the red lamps R, the green lamps G and the blue lamps B are activated to emit light according to the same gradation data, a luminance characteristic and a characteristic of an activating circuit system for each of the red lamps R, the green lamps G and the blue lamps B are selected such that the entire screen displays a white color. Specifically, when one red lamp R, two green lamps G and one blue lamp B, which are adjacent to each other, are activated to emit light according to the same gradation data, light from these four lamps can be seen as white in the human visual system due to selective arrangement additive color mixing (which is a relation that substantially satisfies a white balance equation $Y=0.299R+0.587G+0.114B$).

=Correspondence of Image Data and a Pixel Lamp=

As shown in FIG. 2, the image data to be displayed on the screen is multi-color data of a bitmap format, in which one pixel is expressed by a gathering of red data r, green data g and blue data b. Each of the red data r, the green data g and the blue data b consists of 8 bits, and thus the full color expression of 16,777,216 colors is enabled.

The red lamps R, the green lamps G and the blue lamps B on the display screen and the red data r, the green data g and the blue data b on the bitmap image data plane are made to correspond as follows, and the image is displayed.

In FIG. 1, firstly, attention is paid to the red lamp R33 on the display screen. To the red lamp R33, a group of the total four pixel data 33, 34, 43 and 44, which are adjacent to each other in two rows and two columns on the bitmap image data plane of FIG. 2, are made to correspond. From this pixel group (33, 34, 43 and 44), the red data r33→the red data r34→the red data r44→the red data r43 are selected in order, these data are orderly supplied to an activating circuit of the red lamp R33, and the red lamp R33 is activated to emit light according to the red data r33→r34→r44→r43 sequentially. This action is repeated at a high speed. For example, a lamp-activation by the data of the four pixels is circulated in a cycle of 1/120 second.

Attention is then paid to the green lamp G34 on the right side of the red lamp R33. To the green lamp G34, a pixel group (34, 35, 44 and 45) on the bitmap image data plane is made to correspond. This pixel group (34, 35, 44 and 45) is a group that partially overlaps the pixel group (33, 34, 43 and 44) corresponding to the red lamp R33 and is on the right side of the same.

From the pixel group (34, 35, 44 and 45), the green data g34→the green data g35→the green data g45→the green data g44 are selected in order, these data are orderly supplied to the activating circuit of the green lamp G34, and the green lamp G34 is activated to emit light according to the green data g34→g35→g45→g44 sequentially. This action is repeated at a high speed, synchronizing with the red color control.

Next, attention is paid to the green lamp G43 adjacently under the red lamp R33. To the green lamp G43, a pixel group (43, 44, 53 and 54) on the bitmap image data plane is made to correspond. This pixel group (43, 44, 53 and 54) is a group that partially overlaps the pixel group (33, 34, 43 and 44) corresponding to the red lamp R33 and is adjacently under the same.

From the pixel group (43, 44, 53 and 54), the green data g43→the green data g44→the green data g54→the green data g53 are selected in order, these data are orderly supplied to the activating circuit of the green lamp G43, and the green lamp G43 is activated to emit light according to the green data g43→g44→g54→g53, sequentially. This action is repeated at a high speed, synchronizing with the red color control.

Further, attention is paid to the blue lamp B44 on the lower right of the red lamp R33. To the blue lamp B44, a pixel group (44, 45, 54 and 55) on the bitmap image data plane is made to correspond. This pixel group (44, 45, 54 and 55) is a group that partially overlaps the pixel group (33, 34, 43 and 44) corresponding to the red lamp R33 and is on the lower right of the same.

From the pixel group (44, 45, 54 and 55), the blue data b44→the blue data b45→the blue data b55→the blue data b54 are selected in order, these data are orderly supplied to the activating circuit of the blue lamp B44, and the blue lamp B44 is sequentially activated to emit light according to the blue data b44→b45→b55→b54. This action is repeated at a high speed, synchronizing with the red color control.

=Local Portion and Entire Body=

The local corresponding relation that has been described above is generalized to the entire body of the display screen and the entire body of the bitmap image data plane according to the same regularity. Ref erring to the foregoing embodiment, there are two ways of generalization.

In the first method, a pixel group (35, 36, 45 and 46) on one bitmap image data plane is made to correspond to the red lamp R35 which is two lamps to the right of the red lamp R33, which is the starting point in the foregoing description, and a pixel group (53, 54, 63 and 64) on the bitmap image data plane is made to correspond to the red lamp R53 which is two lamps below the red lamp R33. By generalizing the corresponding relation to the entire screen, the bitmap image data is developed on the display screen, thus the human visual system recognizes the image that is developed in such a manner. According to the first method, one lamp of a certain color is sequentially activated to emit light according to the data for the adjacent four pixels. When attention is paid to one piece of pixel data of a certain color, the information thereof is reflected only on one lamp.

In the second method, a pixel group (34, 35, 44 and 45) on the bitmap image data plane is made to correspond to the red lamp R35 which is two lamps to the right of the red lamp R33, which is the starting point in the foregoing description, and a pixel group (43, 44, 53 and 54) on the bitmap image data plane is made to correspond to the red lamp R53 which is two lamps below the red lamp R33.

Moreover, a pixel group (35, 36, 45 and 46) on the bitmap image data plane is made to correspond to the red lamp R37 which is two lamps to the right of the red lamp R35, and a pixel group (53, 54, 63 and 64) on the bitmap image data plane is made to correspond to the red lamp R73 which is two lamps below the red lamp R53.

By generalizing the corresponding relation to the entire screen, the bitmap image data is developed on the display screen, thus the human visual system recognizes the image that is developed in such a manner. According to the second method, one lamp of a certain color is sequentially activated to emit light according to the data for the adjacent four pixels. This is similar to the first method. However, unlike the first method, in the second method, when attention is paid to one piece of pixel data of a certain color, the information of the data is reflected onto four lamps which are immediately above, under, left and right and which correspond to that color, with a slight time lag.

Another Preferred Embodiment

A display method, according to the local corresponding relation that has been thoroughly described above and for generalizing the local portion to the entire screen according to the second method that has been thoroughly described above, will be called a first algorithm. Description will be made for a second algorithm, which is such where little modification is added to the first algorithm. The second algorithm has the same generalization method as that of the first algorithm, but is a little different from the first algorithm in the local corresponding relation.

The local corresponding relation of the second algorithm will be described in detail. In FIG. 1, firstly, attention is paid to the red lamp R33 on the display screen. The red lamp R33 corresponds to a group of a total of four pixel data 33, 34, 43 and 44, which are adjacent to each other in two rows and two columns on the bitmap image data plane of FIG. 2. From this pixel group (33, 34, 43 and 44), the red data r44→the red data r43→the red data r33→the red data r34 are selected in order, these data are orderly supplied to the activating circuit of the red lamp R33, and the red lamp R33 is sequentially activated to emit light according to the red data r44→r43→r33→r34. This action is repeated at a high speed. For example, a lamp-activation according to the data of the four pixels is circulated in a cycle of 1/120 second.

Attention is then paid to the green lamp G34 on the right side of the red lamp R33. The green lamp G34 corresponds to a pixel group (34, 35, 44 and 45) on the bitmap image data plane. This pixel group (34, 35, 44 and 45) is a group that partially overlaps the pixel group (33, 34, 43 and 44) corresponding to the red lamp R33, and is on the right side of the same.

From the pixel group (34, 35, 44 and 45), the green data g44→the green data g45→the green data g35→the green data g34 are selected in order, these data are orderly supplied to the activating circuit of the green lamp G34, and the green lamp G34 is sequentially activated to emit light according to the green data g44→g45→g35→g34. This action is repeated at a high speed, synchronizing with the red color control.

Next, attention is paid to the green lamp G43 below the red lamp R33. The green lamp G43 corresponds to a pixel group (43, 44, 53 and 54) on the bitmap image data plane. This pixel group (43, 44, 53 and 54) is a group that partially overlaps the pixel group (33, 34, 43 and 44) corresponding to the red lamp R33, and is below the same.

From the pixel group (43, 44, 53 and 54), the green data g44→the green data g43→the green data g53→the green data g54 are selected in order, these data are orderly supplied to the activating circuit of the green lamp G43, and the green lamp G43 is sequentially activated to emit light according to the green data g44→g43→g53→g54. This action is repeated at a high speed, synchronizing with the red color control.

Further, attention is paid to the blue lamp B44 on the lower right of the red lamp R33. The blue lamp B44 corresponds to a pixel group (44, 45, 54 and 55) on the bitmap image data plane. This pixel group (44, 45, 54 and 55) is a group that partially overlaps the pixel group (33, 34, 43 and 44) corresponding to the red lamp R33 and is on the lower right of the same.

From the pixel group (44, 45, 54 and 55), the blue data b44→the blue data b45→the blue data b55→the blue data b54 are selected in order, these data are orderly supplied to the activating circuit of the blue lamp B44, and the blue lamp B44 is sequentially activated to emit light according to the blue data b44→b45→b55→b54. This action is repeated at a high speed, synchronizing with the red color control.

According to the above-described regularity, a lamp-activation according to the data of the four pixels is circulated in a cycle of 1/120 second. This circulation period (1/30 second) will be called a frame, and each of the 1/120 second period obtained by dividing one frame by four is called a field. Moreover, the four fields in one frame are sequentially called a first field, a second field, a third field and a fourth field for distinction.

In the local corresponding relation of the foregoing second algorithm, four lamps R33, G34, G43 and B44 are simultaneously activated to emit light according to the pixel data 44 (r44, g44 and b44) in the first field. In the second field, two lamps R33 and G43 simultaneously emit light according to the pixel data 43, and two lamps G34 and B44 simultaneously emit light according to the pixel data 45. In the fourth field, two lamps R33 and G34 simultaneously emit light according to the pixel data 34, and two lamps G43 and B44 simultaneously emit light according to the pixel data 54.

The above-described local corresponding relation is generalized to the entire screen by the above-described second method, which is the second algorithm. In a state where the generalization is performed to the entire screen, when attention is paid to one pixel data selected in a certain field, adjacent four lamps are simultaneously activated to emit light according to the three primary color data of the pixel data.

=Relation with the Human Visual System=

As it is well known, when the time frequency characteristic and the spatial frequency characteristic of the human visual system are analyzed by dividing them into luminance information and chromaticity information, the luminance information has a higher sensitivity in the high frequency than that of the chromaticity information. Therefore, even if one pixel is not constituted by arranging RGB lamps adjacent to each other as close as possible as in conventional cases, and if the red lamps, the green lamps and the blue lamps are dispersed and arrayed at an even pitch to constitute the display screen, deterioration in reproductivity of the chromaticity information of the image is hardly recognized due to selective arrangement additive color mixing of the human visual system.

On the other hand, resolution of the image is mainly dependent on the luminance information. The display method of the present invention does not faithfully reproduce the resolution that the bitmap image data originally has. However, in the present invention, there is no image information to be abandoned as in the conventional data thinning-out method, and reproductivity of the resolution is also sufficiently high.

Another Embodiment

The constitution of the display screen portion according to the present invention is one in which a large number of pixel lamps are evenly arrayed on the screen in a regular pattern, and additionally, the pixel lamps have three kinds, which are a first-color lamp, a second-color lamp and a third-color lamp. The three kinds of pixel lamps are evenly dispersed on the screen. A concrete lamp array of the pixel lamps is not limited to the embodiment shown in FIG. 1, but the present invention can be applied to many lamp array patterns similar to the foregoing embodiment, and an operational effect similar to the foregoing embodiment can be obtained.

FIG. 3 and FIG. 4 show two lamp array patterns that are different from the embodiment of FIG. 1. In the embodiment of FIG. 3, the red lamp R, the green lamp G and the blue lamp B are arrayed in a row direction in this order, and the lamps of the three colors are also arrayed in a column direction in this order. In the embodiment of FIG. 4, the red lamp R, the green lamp G and the blue lamp B are arrayed in a row direction in this order, and in each row, the lamp array is shifted by a half pitch. When the first color lamp and the second color lamp are adjacent to each other in a certain row, the third color lamp is arranged extremely closely to these two lamps in the rows above and under the lamps.

Moreover, in the above-described embodiment, a total of four pixels, which are adjacent to each other in two rows and two columns on the bitmap image data plane in FIG. 2, constitute one group, and this group corresponds to one pixel lamp. There could be another embodiment for such. For example, in the bitmap image data plane of FIG. 2, a total of three pixels, which are a pixel to which attention is paid, a pixel on the right side thereof and a pixel therebeneath, constitute one group, and this group is made to correspond to one pixel lamp. Alternatively, a total of nine pixels, which are adjacent to each other in three rows and three columns on the bitmap image data plane in FIG. 2, constitute one group, and the group is made to correspond to one pixel lamp. In addition, a total of sixteen pixels, which are adjacent to each other in four rows and four columns on the bitmap image data plane in FIG. 2, constitute one group, and the group is made to correspond to one pixel lamp. In such correspondence, an operational effect similar to that of the above-described embodiment can be obtained.

Note that a display apparatus, which realizes full color display by combination of LEDs of four primary Colors, is known. By evenly arraying, in a regular pattern, such pixel lamps of a first color, a second color, a third color and a fourth color to constitute the display screen according to the idea of the above-described embodiment, preparing bitmap image data where one pixel is expressed by a gathering of data of the first color, the second color, the third color and the fourth color, and carrying out correspondence and distribution control of the data for each pixel and each color on the image data plane and each picture lamp of the display screen based on the above-described idea of the present invention, the operational effect of the present invention that will be described below can be realized similarly.

=Embodiment of Making 16 Pixels Constitute One Group=

Figure 5:
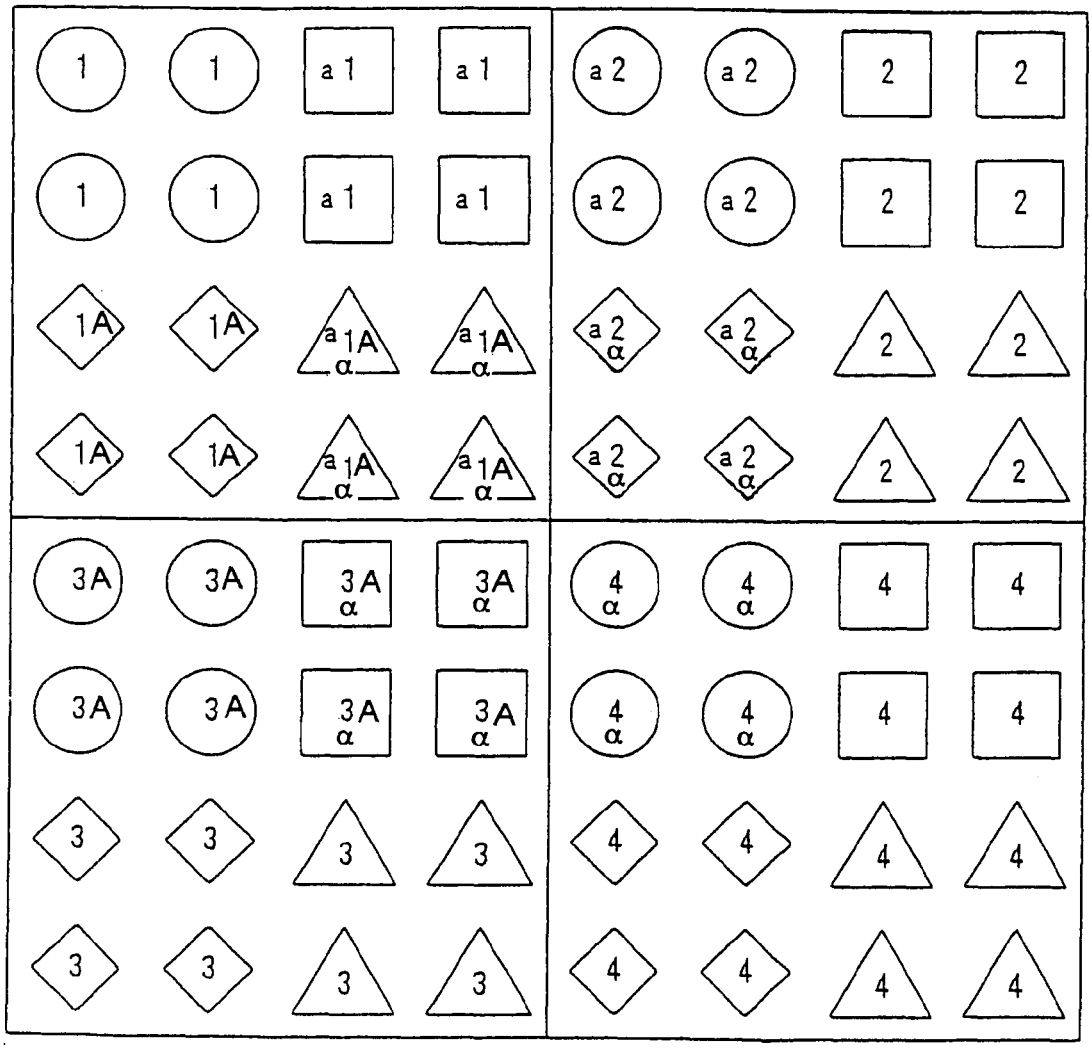
FIG. 5 is a diagram of a bitmap image data plane, explaining the operation of another embodiment of the present invention.

In the above-described second algorithm, a total of four pixels that are adjacent to each other in two rows and two columns on the bitmap image data plane constitute one group, and the group is made to correspond to one lamp. In the third algorithm that will be described below, a total of sixteen pixels that are adjacent to each other in four rows and four columns on the bitmap image data plane constitute one group, and the group is made to correspond to one lamp. FIG. 5 is prepared for describing such a correspondence. FIG. 5 illustrates the pixel array on the bitmap image data plane by marks.

Similarly to the foregoing description, firstly, attention is paid to the red lamp R33. The red lamp R33 corresponds to sixteen pixels denoted by a reference numeral '1' on the data plane of FIG. 5, and these sixteen pixels are called a group '1'. Next, attention is paid to the green lamp G34 on the right side of the red lamp R33. The green lamp G34 corresponds to sixteen pixels denoted by a reference code 'a' on the data plane of FIG. 5, and these sixteen pixels are called a group 'a'. Further, attention is paid to the green lamp G43 under the red lamp R33. The green lamp R43 corresponds to sixteen pixels denoted by a reference code 'A' on the data plane of FIG. 5, and these sixteen pixels are called a group 'A'. Next, attention is paid to the blue lamp B44 on the lower right of the red lamp R33. The blue lamp B44 corresponds to sixteen pixels denoted by a reference code 'α' on the data plane of FIG. 5, and these sixteen pixels are called a group 'α'.

The way the pixels are divided into each of the four groups '1', 'a', 'A' and 'α' is such that they are mutually positionally-shifted on the bitmap image data plane while being partially overlapped as shown in FIG. 5, interrelating with a positional-shift in the arrays of the red lamp R33, the green lamp G34, the green lamp G43 and the blue lamp B44 on the display screen.

The sixteen pixels that belong to each group '1', 'a', 'A' and 'α' are divided into four subgroups, each of which having four pixels, as shown in FIG. 5, and each of the subgroups are called a subgroup ○, a subgroup □, a subgroup ◇ and a subgroup Δ. In addition, the above-described field is divided into four fields, each having a cycle of 1/480 seconds. For describing this, for example, the above-described first field is assumed to consist of a first 'a' field, a first 'b' field, a first 'c' field and a first 'd' field. When the first field is mentioned, it indicates an entirety of these four fields.

With regard to the red lamp R33, in the first field, activation is performed according to data for the four pixels of the subgroup Δ in the group '1'. In a sequence of: the first 'a' field→the first 'b' field→the first 'c' field→the first 'd' field, the four pixels of the subgroup Δ are sequentially selected clockwise starting from the upper left pixel. In the second field, data of the four pixels of the subgroup ◇ is sequentially selected in the same order as described above (clockwise from the upper left pixel), and the red lamp R33 is activated. In the third field, data of the four pixels of the subgroup ○ is sequentially selected in the same order as described above (clockwise from the upper left pixel), and the red lamp R33 is activated. In the fourth field, data of the four pixels of the subgroup □ is sequentially selected in the same order as described above (clockwise from the upper left pixel), and the red lamp R33 is activated.

With regard to the green lamp G34, in the first field, activation is performed according to data for the four pixels of the subgroup Δ in the group 'a'. In a sequence of: the first 'a' field→the first 'b' field→the first 'c' field→the first 'd' field, the four pixels of the subgroup Δ are sequentially selected clockwise starting from the upper left pixel. In the second field, data of the four pixels of the subgroup ◇ is sequentially selected in the same order as described above (clockwise from the upper left pixel), and the green lamp G34 is activated. In the third field, data of the four pixels of the subgroup ○ is sequentially selected in the same order as described above (clockwise from the upper left pixel), and the green lamp G34 is activated. In the fourth field, data of the four pixels of the subgroup □ is sequentially selected in the same order as described above (clockwise from the upper left pixel), and the green lamp G34 is activated.

With regard to the green lamp G43, in the first field, activation is performed according to data for the four pixels of the subgroup Δ in the group 'A'. In a sequence of: the first 'a' field→the first 'b' field→the first 'c' field→the first 'd' field, the four pixels of the subgroup Δ are sequentially selected clockwise starting from the upper left pixel. In the second field, data of the four pixels of the subgroup ◇ is sequentially selected in the same order as described above (clockwise from the upper left pixel), and the green lamp G43 is activated. In the third field, data of the four pixels of the subgroup ○ is sequentially selected in the same order as described above (clockwise from the upper left pixel), and the green lamp G43 is activated. In the fourth field, data of the four pixels of the subgroup □ is sequentially selected in the same order as described above (clockwise from the upper left pixel), and the green lamp G43 is activated.

With regard to the blue lamp B44, in the first field, activation is performed according to data for the four pixels of the subgroup Δ in the group 'α'. In a sequence of: the first 'a' field→the first 'b' field→the first 'c' field→the first 'd' field, the four pixels of the subgroup Δ are sequentially selected clockwise starting from the upper left pixel. In the second field, data of the four pixels of the subgroup ◇ is sequentially selected in the same order as described above (clockwise from the upper left pixel), and the blue lamp B44 is activated. In the third field, data of the four pixels of the subgroup ○ is sequentially selected in the same order as described above (clockwise from the upper left pixel), and the blue lamp B44 is activated. In the fourth field, data of the four pixels of the subgroup □ is sequentially selected in the same order as described above (clockwise from the upper left pixel), and the blue lamp B44 is activated.

The above-described local corresponding relation is generalized to the entire screen according to the same regularity as that of the above-described second algorithm, which is the third algorithm. The sixteen pixels of the group '2' on the bitmap image data plane of FIG. 5 are made to correspond to the red lamp R35 two pieces to the right of the red lamp R33, which is the starting point in the foregoing description, and sixteen pixels of the group '3' on the bitmap image data plane of FIG. 5 are made to correspond to the red lamp R53 which is two pieces below the red lamp R33. According to the third algorithm, an excellent effect similar to that of the second algorithm can be obtained.

=Constitution of the Display Apparatus=

One of the features of the display apparatus according to the present invention is embodied in the array of the pixel lamps of the display screen in an aspect of a hardware constitution. This has already been explained. The display apparatus of the present invention is constituted of: a dot matrix-type display screen section having such array of the pixels; an activating circuit section for individually activating and causing light emission of a large number of the red lamps, the green lamps and the blue lamps included in the display screen section to emit light; an image data storing section for storing bitmap multi-color image data to be displayed; and a data distribution control section for distributing and transferring the image data stored in the image data storing section to the activating circuit section. The principle part of the hardware constitution is substantially the same as that of the conventional apparatus.

What is significantly different from the conventional apparatus is: time processing, where the above-described data distribution control section distributes image data stored in the above-described storing section to each lamp-activating-cell in the above-described activating circuit section; and a corresponding relation of the pixel data and the pixel lamp. This also has already been described in detail. The kind of circuit systems and computer systems to be used for realizing the technical items is not particularly difficult for those skilled in the art to perceive, and thus description thereof is omitted in this specification.

Effect of the Invention

When pixel lamps of each color of RGB (LED chip, for example) are lined-up as densely as possible to constitute a display screen having a high resolution, the constitution will ultimately be such in which: a large number of pixel lamps are evenly arrayed on the screen in a regular pattern; there are three kinds of pixel lamps, which are a first color lamp, a second color lamp and a third color lamp; and the three kinds of pixel lamps are evenly dispersed on the screen, as exemplified in FIG. 1, FIG. 3 and FIG. 4. This constitution can be said to be a configuration wherein no useless space is included among the lamps, and such a configuration is one source of the effect of the present invention for realizing a high-resolution display.

In addition, images, such as actually-filmed images or computer graphics images that are provided on an NTSC video signal used in a regular television broadcasting system or a VTR, or on a Hi-vision video signal, are extremely high definition image data; and digital bitmap image data, where such high definition image data is sampled and quantized with high fineness, is more sufficiently high in density than the density of the pixel lamp array in the above-described display screen. This difference in density is the technical matter which poses the premise for the present invention. And, the present invention concretely provides a technique in how to control and display image data, which is constituted of sufficiently highly dense pixels, on a display screen having pixels array with a relatively low density for reproducing the high expression ability the image data possesses, without deteriorating such ability to the furthest extent.

The invention claimed is:

1. A display controller comprising:

(A) a display data output section that is configured to output display data to a display screen, the display screen being provided with a plurality of first color lamps, a plurality of second color lamps, and a plurality of third color lamps, each pixel of said display screen consisting of one of said first color lamps, said second color lamps, and said third color lamps, and to drive each of said lamps so that they emit light; and (B) a data distribution control section that is configured to receive image data being made of a plurality of pixel data sets, each said pixel data set including first color data, second color data, and third color data and carry out:

(1) a correlating step of performing the steps of:

correlating, to each said first color lamp, a first color group that is made up of a predetermined number of pixel data sets among said plurality of pixel data sets in said image data, the position of each said first color lamp corresponding to the position, in said image data, of the first color group correlated to that first color lamp;

correlating, to each said second color lamp, a second color group that is made up of a predetermined number of pixel data sets among said plurality of pixel data sets in said image data, the position of each said second color lamp corresponding to the position, in said image data, of the second color group correlated to that second color lamp; and correlating, to each said third color lamp, a third color group that is made up of a predetermined number of pixel data sets among said plurality of pixel data sets in said image data, the position of each said third color lamp corresponding to the position, in said image data, of the third color group correlated to that third color lamp; and (2) a selecting and data distributing step of performing, in synchronization with one another, the steps of:

for each said first color lamp and each said first color group, sequentially selecting a pixel data set from among the pixel data sets of each said first color group, and, each time a pixel data set is selected, sequentially supplying the first color lamp correlated to that first color group with the first color data of the selected pixel data set;

for each said second color lamp and each said second color group, sequentially selecting a pixel data set from among the pixel data sets of each said second color group, and, each time a pixel data set is selected, sequentially supplying the second color lamp correlated to that second color group with the second color data of the selected pixel data set; and for each said third color lamp and each said third color group, sequentially selecting a pixel data set from among the pixel data sets of each said third color group, and, each time a pixel data set is selected, sequentially supplying the third color lamp correlated to that third color group with the third color data of the selected pixel data set;

wherein, at each timing for supplying the data, each of said first, second, and third color lamps is caused to emit light based on a different pixel data set; and wherein the first color group correlated to one first color lamp partially overlaps the first color group correlated to another first color lamp adjacent to said one first color lamp, the second color group correlated to one second color lamp partially overlaps the second color group correlated to another second color lamp adjacent to said one second color lamp, and the third color group correlated to one third color lamp partially overlaps the third color group correlated to another third color lamp adjacent to said one third color lamp.

* * * * *